United States Patent [19]

Lloyd et al.

[11] Patent Number: 5,028,392

[45] Date of Patent: Jul. 2, 1991

[54] MELT PROCESS FOR THE PRODUCTION OF METAL-MATRIX COMPOSITE MATERIALS WITH ENHANCED PARTICLE/MATRIX WETTING

[75] Inventors: David J. Lloyd, Kingston; Alan D. McLeod, Yarker; Philip L. Morris, Napanee; Iljoon Jin, Kingston, all of Canada

[73] Assignee: Alcan International Ltd., Montreal, Canada

[21] Appl. No.: 538,225

[22] Filed: Jun. 14, 1990

[51] Int. Cl.[5] ..... C22C 1/10; C22C 1/09

[52] U.S. Cl. ..... 420/528; 420/590

[58] Field of Search ..... 420/528, 590

[56] References Cited

U.S. PATENT DOCUMENTS

| | | | |
|---|---|---|---|
| 4,786,467 | 11/1988 | Skibo et al. | 420/590 |
| 4,865,806 | 9/1989 | Skibo et al. | 420/590 |
| 4,946,647 | 8/1990 | Rohatgi et al. | 420/528 |

*Primary Examiner*—R. Dean

*Assistant Examiner*—David W. Schumaker

*Attorney, Agent, or Firm*—Gregory Garmong; James Rich

[57] ABSTRACT

A metal matrix composite material containing discontinuous particles in a metallic matrix is prepared by forming a mixture of the molten alloy and the particles in a closed reactor, removing oxygen from the interior of the reactor, statically pressurizing the interior of the reactor with nitrogen gas, mixing the mixture of the molten alloy and particles in the presence of the static nitrogen gas to wet the molten matrix to the particles, and evacuating the interior of the reactor in a stepwise manner. The nitrogen gas aids in wetting the metallic alloy to the particles by forming aluminum nitride at the particle-molten matrix interface, so that a lower contact angle of the alloy to the particle results. Oxygen that may be present in the sealed reactor is gettered by the aluminum, and the nitrogen is removed by stepwise evacuation, thereby minimizing the introduction of gas into, and retention of gas within, the melt.

20 Claims, 2 Drawing Sheets

MELT PROCESS FOR THE PRODUCTION OF METAL-MATRIX COMPOSITE MATERIALS WITH ENHANCED PARTICLE/MATRIX WETTING

BACKGROUND OF THE INVENTION

This invention relates to the preparation of metal-matrix composite materials by a melting and mixing process, and, more particularly, to a technique for enhancing the wetting of the matrix to the particulate reinforcement.

In one approach for manufacturing composite materials, a metallic alloy is melted in a reactor, and particles of a reinforcing material are added to the melt. The metallic alloy and the particulate material are mixed under vacuum and with high shear conditions to cause the metallic alloy to wet the particles. The wetted particles are not rejected from the melt, so that the wetted particles thereafter remain distributed throughout the melt with only gentle stirring.

Upon cooling and solidification of the metal, a generally uniform distribution of discontinuous reinforcing particles is present throughout a metallic alloy matrix. Desirably, there are few voids in the composite material and little or no other reaction products. The composite material exhibits specific modulus and strength properties, as well as wear resistance, superior to those of the unreinforced matrix material, with moderately increased cost. Composite materials produced by this technique, as described in U.S. Pat. Nos. 4,759,995 and 4,786,467, have enjoyed considerable commercial success in only a few years after their first introduction.

The wetting of the molten metal to the particles is critical to the success of composite materials fabrication by this technique. If the particles are not completely wetted, a high void fraction is present, and the mechanical properties of the composite are poor.

Thus, while the described high-shear mixing process is fully operable, there is an ongoing need for a technique that would improve the degree of wetting of each particle, accelerate wetting, or ensure that all particles are fully wetted during the high-shear mixing process.

Various techniques have been proposed for improving wetting of the matrix to the particles during the mixing process. Most involve either making alloy additions to the matrix or precoating the surfaces of the particles with a layer that is more easily wetted than is the particle itself. For example, it is known that about 1 to 3 weight percent magnesium alloying content in the matrix is useful in improving wetting to oxide particles. A thin nickel coating on an aluminum oxide particle will improve wetting of aluminum alloys to the particles.

While such techniques are each valuable in certain circumstances, they limit the general applicability of the technique. There is therefore a need for an improved mixing process to achieve more complete wetting of the matrix to the particles. The present invention fulfills this need, and further provides related advantages.

SUMMARY OF THE INVENTION

The present invention provides an improved process for preparing metal matrix composite materials of discontinuous particles in a metallic matrix. Such composites include, for example, aluminum oxide particles in an aluminum-alloy matrix, but the applicability of the invention is not so limited. The composite material is prepared by the economical melting and casting technique, but with a modified processing that may result in improved wetting of the matrix to the particles.

In accordance with the invention, a process for preparing a metal matrix composite material comprises the steps of preparing in a closed reactor a mixture of a molten aluminum alloy containing at least some magnesium, and particles that do not dissolve in the molten aluminum alloy, the particles being present in an amount of less than about 35 volume percent of the total mixture; applying a vacuum to the mixture; statically pressurizing the interior of the reactor with nitrogen gas; mixing the mixture of aluminum alloy and particles under the static nitrogen atmosphere to wet the particles with the alloy; and removing the nitrogen gas from the mixture.

The aluminum alloy that is melted and becomes the matrix of the composite material upon solidification contains at least some magnesium, and about 0.15 weight percent has been found satisfactory. This low level of magnesium is much less restrictive than the 1-3 percent required in some prior processing techniques. The composite having a low magnesium level is more readily recycled than are aluminum-magnesium composites with higher magnesium levels. No special coating need be applied to the particles to assist in wetting.

A key feature of the present invention is the static pressurization of the interior of the reactor with nitrogen during mixing. The nitrogen gas appears to have two important effects. First, it reduces the content of oxygen below the level where it is harmful to the wetting process. Even the most pure nitrogen gas contains some small amount of oxygen, and the use of static pressurization is critical to avoiding an adverse effect of that small amount of oxygen. By "static" pressurization is meant that the reactor is filled with nitrogen to some selected pressure above ambient pressure and then sealed.

Static pressurization is to be contrasted with the application of a dynamic, continuously pumped vacuum. The partial pressure of oxygen is about 0.2 torr under a dynamic applied vacuum and is constant, much too high a level for operability of the present invention. By using static pressurization, a much lower oxygen content can be achieved. Any oxygen in the nitrogen is gettered by the molten aluminum. Because the system is sealed, the oxygen is not replaced, and the oxygen content of the atmosphere is thereby reduced below the pressure that causes preferential formation of aluminum oxide over aluminum nitride.

Static pressurization is also to be contrasted with a flowing gas atmosphere wherein there is a continual flow of gas through the reactor. In that case, there is a continual resupply of any oxygen present in the nitrogen, leading to inhibition of the wetting.

The partial pressure of nitrogen also aids in wetting the aluminum alloy to the particles.

Mixing is conducted to minimize the introduction of the nitrogen gas into the molten mixture, as by using the vortex-free mixing procedure of U.S. Pat. Nos. 4,759,995 and 4,786,467. However, some small amount of the nitrogen gas may be incorporated into the melt, and it is important to minimize the retention of bubble-forming gases within the composite prior to solidification.

It has been found that the gas atmosphere used in the present procedure can be removed by a stepwise evacuation process wherein a slight vacuum level is applied to the interior of the reactor, that vacuum level is maintained for a period of time to permit equilibration, a higher vacuum is applied for a period of time, and so on. The stepwise vacuum treatment avoids the production of foam in the metal as the gas is drawn out. In one preferred approach, residual nitrogen is removed from the melt by applying a vacuum of 600 torr for 2 minutes, 400 torr for 2 minutes, 200 torr for 2 minutes, 100 torr for 2 minutes, and 1 torr or less for 10 minutes. Longer times at each evacuation level are not harmful, but substantially shorter times can lead to incomplete removal of nitrogen from the molten material, and either foaming in the subsequent stages or retention of gas bubbles in the final composite material.

More generally, then, a process for preparing a metal matrix composite material comprises the steps of preparing in a closed reactor a mixture of a molten aluminum alloy, and particles that do not dissolve in the aluminum alloy; and wetting the molten aluminum alloy to the particles under conditions such that the partial pressure of oxygen gas is below the pressure required for the formation of aluminum oxide and the partial pressure of nitrogen gas is above that required for the formation of aluminum nitride.

The composite material produced by the present approach is improved over that obtained without the use of nitrogen gas in many circumstances. The void content is reduced, as is the formation of interface reaction products, such as spinels at the particle/matrix interface. The attainment of good quality material is more certain in the sense that it is less dependent upon the skill of the operator. Other features and advantages of the invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENT

Figure 2:
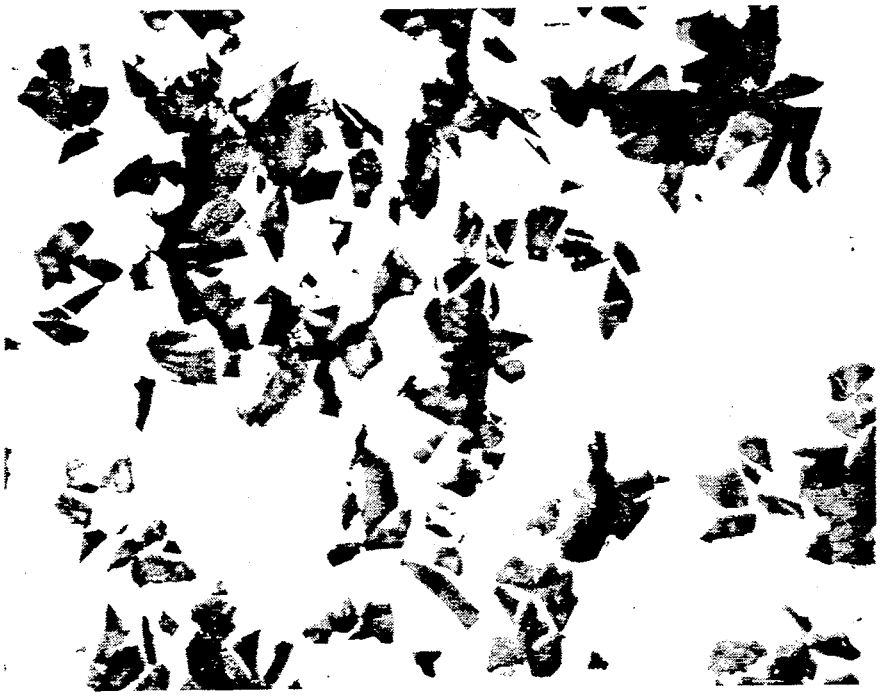
FIG. 2 is a photomicrograph of a composite material prepared without a nitrogen gas addition.
Figure 3:
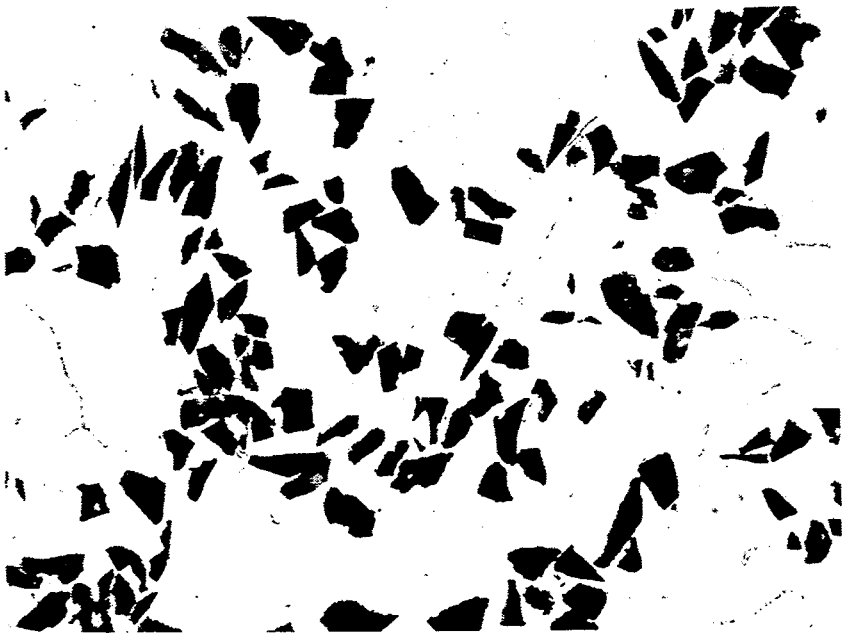
FIG. 3 is a photomicrograph of a composite material prepared with a nitrogen gas addition.

The invention is preferably practiced with the apparatus disclosed in relation to FIG. 3 of U.S. Pat. No. 4,786,467 and FIG. 1 of U.S. Pat. No. 4,759,995, and will not be described in detail. The disclosures of these two patents are incorporated by reference herein in their entirety, both as to apparatus and procedures. The interior of the reactor is evacuated and filled with selected gases through the port 42, as described at col. 6, line 10–14 of the '995 patent. Mixing is preferably accomplished using a dispersing impeller of the type illustrated in FIGS. 2–4 of the '467 patent, and with minimal vortex generation as described in relation to FIG. 1 of the '467 patent.

In the preferred approach, composite preparation begins with the melting of the matrix alloy in the crucible of the closed reactor. A variety of aluminum alloys have been prepared according to the invention, including low-alloy, silicon-alloyed, and copper-alloyed materials. Preferably, the alloy should contain at least some magnesium. A minimum operable amount is believed to be about 0.03 percent by weight of the aluminum alloy. About 0.15 percent by weight is preferred, unless the customer should request more. The magnesium is believed to have the following beneficial effects. First, the oxide skin at the surface of the melt may change from $Al_2O_3$ to $MgAl_2O_4$. Second, magnesium nitride $Mg_3N_2$ may form at the surface of the melt. Both changes aid in improving wettability of the molten matrix alloy to the particles, after they are added.

The particulate matter is next added to the molten metallic alloy, preferably by pouring it onto the surface of the melt. The amount of particulate matter is selected such that the final, as-solidified composite material has from about 5 to about 35 volume percent of the particulate matter, and from about 95 to about 65 percent by volume of the metallic alloy. For smaller amounts of particulate matter, there is an insignificant effect on material properties. For larger amounts of particulate matter, the molten mixture becomes too viscous for high-shear mixing and can no longer be considered a free-flowing mixture.

The particulate matter is preferably dried discontinuous particles of aluminum oxide, having a minimum dimension of about 1 micrometer and a ratio of maximum dimension to minimum dimension ("aspect ratio") of from about 1 to about 5. Smaller minimum dimensions and higher aspect ratios tend to inhibit high shear mixing, but the invention remains operable even with these non-optimal particles.

The reactor containing the molten metal and the particulate matter is sealed and evacuated to a pressure of less than about 1 torr. The objective of this evacuation step is to remove as much oxygen and other contaminant gases from the interior of the reactor as possible. These gases originate both from the atmosphere within the reactor and from the melted mixture.

The reactor is then backfilled with nitrogen gas. The nitrogen inevitably contains at least a small partial pressure of oxygen, even if supplied in a purified form. By using a static atmosphere, the harmful effect of the oxygen is minimized.

A nitrogen atmosphere during high-shear mixing is beneficial because nitrogen that enters the melt immediately reacts to form nitrides such as aluminum nitride or magnesium nitride at all melt surfaces, including those adjacent the aluminum oxide particles. The presence of the nitrides promotes wetting by decreasing the effective contact angle between the surface of the aluminum melt and the particles. The formation of the nitrides minimizes the introduction of gas into the melt, because any gas that does enter the melt reacts to a beneficial solid product.

Figure 1:
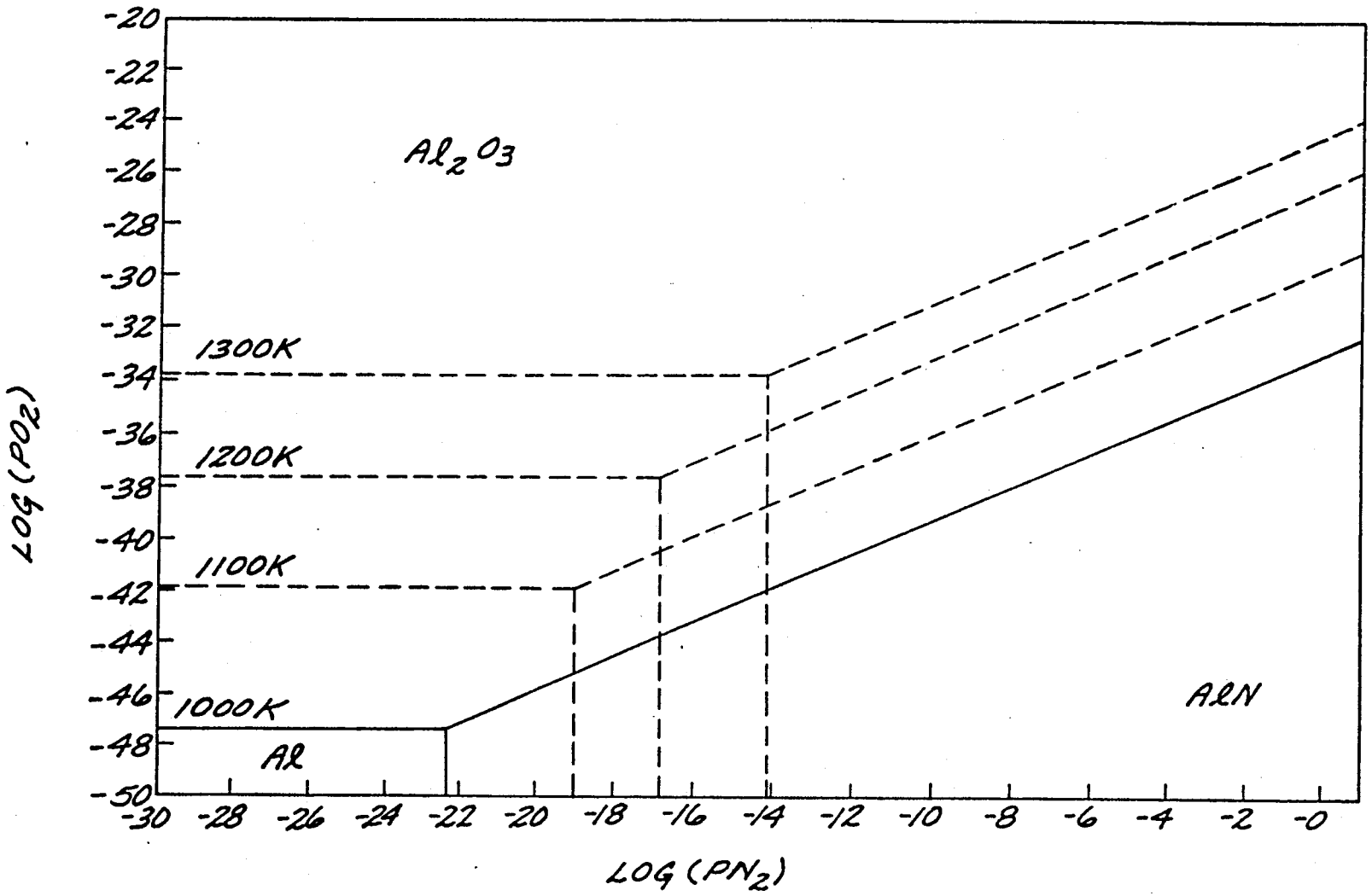
FIG. 1 is a stability diagram illustrating the effect of oxygen and nitrogen content.

It is well known that aluminum quickly forms oxide skins when sufficient oxygen is present. If the partial pressure of oxygen in the atmosphere is too high, an undesirable oxide skin will form in preference to a desirable nitride reaction product on the surfaces of the melt. FIG. 1 is a stability diagram for the oxygen/nitrogen atmosphere system of interest. FIG. 1 indicates the ranges of thermodynamic stability for each phase as a function of the partial pressures of nitrogen and oxygen. Aluminum nitride, AlN, is the desired phase, and therefore the mixing should be operated at an oxygen pressure below that required for AlN formation. Since mixing occurs at about 730°–750° C., the stability regions for 1000K are most pertinent and are shown in solid lines. The dashed lines indicate the stability regions for other temperatures. It will be appreciated that FIG. 1 is developed from thermodynamic data and does not reflect the kinetics of phase changes. As such, it should be used as a basis for understanding rather than a detailed guide to pressure selection. Lower non-equilibrium partial pressures can be obtained in the presence of the alumina particulate since the decomposition of the particulate to AlN will be slow. As will be seen, in the approach of the invention there is no need for precise control over gas pressures.

For a nitrogen pressure of about 1 atmosphere (log $pN_2=0$), the corresponding oxygen partial pressure is about $10^{-34}$ atmosphere. That is, if the oxygen partial pressure is greater than about $10^{-34}$ atmosphere, aluminum nitride will not form even though the partial pressure of nitrogen is far higher than the partial pressure of oxygen. It is virtually impossible to obtain nitrogen gas having a partial pressure of oxygen of less than $10^{-34}$ atmosphere, at least commercially. If the atmosphere within the reactor is a flowing atmosphere, the oxygen impurity in the nitrogen gas is continually replenished and aluminum nitride is not formed.

In the present approach, the reactor contains a static nitrogen atmosphere. "Static" means that the reactor is filled with the selected gas and sealed, and is contrasted with a free flowing gas stream as used in many processes to sweep away evolved impurities. (A small addition of nitrogen is permitted under "static" approach to maintain pressure within the reactor.)

With a static nitrogen atmosphere, any oxygen present is reacted with the aluminum to form aluminum oxide as indicated in FIG. 1, but that reacted oxygen is not replaced. As the impurity oxygen present in the initial fill of the reactor is used up, the partial pressure of oxygen gradually falls until it is less than $10^{-34}$ atmosphere. From that point on aluminum nitride is preferentially formed at the surfaces of the melt, including those in contact with the particles. The amount of oxygen in the initial nitrogen backfill is as low as possible. The higher the initial oxygen content, the longer the period of time required to getter that oxygen. The preferred oxygen content of the backfilled nitrogen gas is less than about $10^{-5}$ atmospheres, as such gas is available commercially.

Similar principles hold for other nitrides that may be formed, such as magnesium nitride. In each case, the key is the gettering of the oxygen in the static atmosphere, as by the aluminum itself. While sealed reactors and gettering effects have been known previously, there has been no application of the principles in promoting the formation of a beneficial interfacial nitride wetting promoter, as in the present invention.

The pressure of the nitrogen is preferably slightly greater than one atmosphere, the ambient air pressure, as by about 20 torr. The slightly elevated nitrogen pressure ensures that there will be no oxygen leaks into the reactor, and that any leaks will be nitrogen leaks out of the reactor. Even though the nitrogen reacts to form nitrides during the course of the mixing operation, only a very small amount of the available gaseous nitrogen is consumed in the reactions. The partial pressure of nitrogen in the reactor therefore stays roughly constant, but that constancy is not required for the operability of the invention. If the pressure were to drop too much, additional backfill nitrogen gas can be added to the static atmosphere. The oxygen in the additional backfill gas will be gettered in the manner discussed previously, and the nitride forming reactions will thereafter continue. The addition of small amounts of gas to maintain pressure is within the scope of a "static" atmosphere, because impurity oxygen is not being continually added at a rate that cannot be gettered.

High shear mixing of the melt is accomplished in the manner generally described in the '467 and '995 patents, except with the nitrogen atmosphere as discussed. In a preferred approach, the molten mixture is maintained at a temperature of from about 730° to about 750° C. during mixing. The mixing impeller is operated at a rate of 1150 revolutions per minute for about 60 minutes. These values are not critical to the success of the process.

At the completion of the mixing operation, the nitrogen gas is removed from the reactor to minimize the retention of gas within the composite material. The preferred approach is a stepwise evacuation with a vacuum pump. During the stepwise evacuation, the mixing impeller continues to operate as during the mixing step. A satisfactory and preferred stepwise evacuation includes evacuation to the following pressures and holding times at that pressure: 600 torr for 2 minutes, 400 torr for 2 minutes, 200 torr for 2 minutes, 100 torr for 2 minutes, and full vacuum, about 1 torr or less, for 10 minutes. Removal of the nitrogen gas becomes more difficult for higher fractions of particles in the melt and the degassing pressure and times may have to be modified. The above combination of pressures and times is operable for the preferred embodiment of aluminum oxide particles in various aluminum alloys.

When this degassing procedure is complete, the composite material is cast and solidified using the procedures disclosed in the '467 and '995 patents, or any other acceptable casting procedure.

FIGS. 2 and 3 depict the microstructures of alloys produced without the approach of the invention, and produced with the approach of the invention, respectively. FIG. 2 is the microstructure of a composite material having 2219 aluminum alloy (containing no magnesium) plus 10 volume percent aluminum oxide particles, while FIG. 3 is the microstructure of a composite material having a matrix of 2219 aluminum plus 0.15 weight percent magnesium plus 10 volume percent aluminum oxide particles. The composite material of FIG. 3 was produced using the preferred process described herein, while the material of FIG. 2 was produced without the use of nitrogen gas. The composite material of FIG. 2 exhibits gas pores and incomplete wetting, while the composite material of FIG. 3 is free of porosity and appears to have good wetting.

In other examples, the following composite materials have been successfully prepared by the approach of the invention:

(1) A composite material having a matrix of 6.3 weight percent copper, 0.15 weight percent magnesium, balance aluminum, plus 10 volume percent fused aluminum oxide particles.

(2) A composite material having a matrix of 5.2 weight percent silicon, 0.15 weight percent magnesium, balance aluminum, plus 10 volume percent of fused aluminum oxide particles.

(3) A composite material having a matrix of 5.2 weight percent silicon, 0.15 weight percent magnesium, balance aluminum, plus 15 volume percent of fused aluminum oxide particles.

(4) A composite material having a matrix of 5.2 weight percent silicon, 0.15 weight percent magnesium, balance aluminum, plus 10 volume percent of calcined aluminum oxide particles.

(5) A composite material having a matrix of 6.3 weight percent copper, 1 weight percent silicon, 0.15 weight percent magnesium, plus 10 volume percent of fused aluminum oxide particles.

Other studies have shown that the composite materials of the invention are more suitable for remelting and recycling than are those composite materials made with a high magnesium content matrix alloy. In these studies, composites whose matrix alloys have about 0.12–0.18 weight percent magnesium were prepared, and then remelted at 730° C. for 1 or 2 hours. The specimens were then resolidified and analyzed. The magnesium loss upon remelting and holding for 2 hours was at most 0.05 percent, and there is substantially no formation of spinel or other types of inclusions in the remelted material.

Although particular embodiments of the invention have been described in detail for purposes of illustration, various modifications may be made without departing from the spirit and scope of the invention. Accordingly, the invention is not to be limited except as by the appended claims.

What is claimed is:

1. A process for preparing a metal matrix composite material, comprising the steps of:

preparing in a closed reactor a mixture of a molten aluminum alloy containing at least some magnesium, and particles that do not dissolve in the aluminum alloy, the particles being present in an amount of less than about 35 volume percent of the total mixture;

applying a vacuum to the mixture;

statically pressurizing the interior of the reactor with nitrogen gas;

mixing the mixture of aluminum alloy and particles under the static nitrogen atmosphere to wet the particles with the alloy; and evacuating the interior of the reactor in a stepwise manner.

2. The process of claim 1, wherein the molten aluminum alloy has less than about 1 percent by weight of magnesium.

3. The process of claim 1, wherein the molten aluminum alloy has about 0.15 percent by weight magnesium.

4. The process of claim 1, wherein the molten aluminum alloy further contains copper.

5. The process of claim 1, wherein the molten aluminum alloy further contains silicon.

6. The process of claim 1, wherein the particles are aluminum oxide.

7. The process of claim 1, wherein the pressure of the nitrogen gas in the step of statically pressurizing is greater than one atmosphere.

8. The process of claim 1, wherein the step of evacuating the mixture includes the steps of:

evacuating the mixture to about 600 torr for at least about 2 minutes;

evacuating the mixture to about 400 torr for at least about 2 minutes;

evacuating the mixture to about 200 torr for at least about 2 minutes;

evacuating the mixture to about 100 torr for at least about 2 minutes; and evacuating the mixture to less than about 1 torr for at least about 10 minutes.

9. The process of claim 1, including the additional step, after the step of evacuating, of solidifying the mixture.

10. A process for preparing a metal matrix composite material, comprising the steps of:

preparing in a closed reactor a mixture of a molten aluminum alloy containing at least some magnesium, and particles that do not dissolve in the molten aluminum alloy, the particles being present in an amount of less than about 35 volume percent of the total mixture;

applying a vacuum to the mixture;

statically pressurizing the interior of the reactor with nitrogen gas;

mixing the mixture of aluminum alloy and particles under the static nitrogen atmosphere to wet the particles with the alloy; and removing the nitrogen gas from the mixture.

11. A process for preparing a metal matrix composite material, comprising the steps of:

preparing in a closed reactor a mixture of a molten aluminum alloy, and particles that do not dissolve in the aluminum alloy; and wetting the molten aluminum alloy to the particles under conditions such that the partial pressure of oxygen gas is below the pressure required for the formation of aluminum oxide and the partial pressure of nitrogen gas is above that required for the formation of aluminum nitride.

12. The process of claim 11, wherein the step of wetting is accomplished by mixing the mixture with an impeller.

13. The process of claim 11, wherein the step of wetting is accomplished in a closed vessel with a static pressurization of nitrogen over the molten mixture.

14. The process of claim 11, wherein the step of wetting includes the steps of:

mixing the molten metal with an impeller in a closed vessel under a static pressurization of nitrogen, and evacuating the nitrogen from the interior of the vessel in a stepwise manner.

15. The process of claim 11, wherein the molten aluminum alloy contains from about 0.03 weight percent to about 1 weight percent of magnesium.

16. The process of claim 11, wherein the molten aluminum alloy has about 0.15 percent by weight magnesium.

17. The process of claim 11, wherein the molten aluminum alloy further contains copper.

18. The process of claim 11, wherein the molten aluminum alloy further contains silicon.

19. The process of claim 11, wherein the particles are aluminum oxide.

20. The process of claim 11, wherein the partial pressure of the nitrogen gas in the step of wetting is greater than one atmosphere.

* * * * *